United States Patent [19]

Campbell

[11] 4,099,891

[45] Jul. 11, 1978

[54] SAWTOOTHED DIFFUSER, VANED, FOR CENTRIFUGAL COMPRESSORS

[75] Inventor: Kenneth Campbell, Ridgewood, N.J.

[73] Assignee: Miriam N. Campbell, Oradell, N.J.

[21] Appl. No.: 815,787

[22] Filed: Jul. 14, 1977

[51] Int. Cl.[2] ..... F01D 1/02; F01D 9/00

[52] U.S. Cl. ..... 415/207; 415/211

[58] Field of Search ..... 415/181, 207, 210, 211, 415/182, 209, 216, 217, 219 B

[56] References Cited

U.S. PATENT DOCUMENTS

| | | | |
|---|---|---|---|
| 3,150,823 | 9/1964 | Adams | 415/207 |
| 3,765,792 | 10/1973 | Exley | 415/207 |
| 3,778,186 | 12/1973 | Bandukwalla | 415/211 |

*Primary Examiner*—Louis J. Casaregola

[57] ABSTRACT

This invention is proposed as an aerodynamically more efficient vaned diffuser for centrifugal compressors than heretofore achieved, while still respecting the usual diffuser requirement of a limited overall diameter. The invention is so to shape the early entering portion of the diffuser side-walls and the vanes as to achieve for the first time, isobars across the so-called throat which are highly oblique to the flow direction there, instead of heretofore always an isobar which is very nearly normal or normal across the passage at that throat. This is more understandably but still briefly explained in the two sections following, on Background, and Summary, of the Invention.

6 Claims, 5 Drawing Figures

PRE-COMPUTED VANE & SIDE-WALL ESSENTIAL VALUES

| STA. NO | FOR "PRESSURE"-SIDE of VANE | | | | | | | FOR "SUCTION"-SIDE of VANE | | | | | | |
|---|---|---|---|---|---|---|---|---|---|---|---|---|---|---|
| | M | $h/h_1$ | h" | α° | $R/R_1$ | Δθ° | θ° | M | $h/h_1$ | h" | α° | $R/R_1$ | Δθ° | θ° |
| 0 (TIP) | .90 | 1.00 | 2.00" | 22.5° | 1.00 | 0° | 0° | .90 | 1.00 | 2.00" | 22.5° | 1.00 | 0° | 0° |
| 1 | .891 | 1.00 | 2.00" | 22.35° | 1.016 | 2.142° | 2.14° | .884 | 1.092 | 2.183" | 20.55° | 1.014 | 2.114° | 2.11° |
| 2 | .880 | 1.00 | 2.00" | 22.19° | 1.033 | 3.398° | 4.54° | .869 | 1.194 | 2.388" | 18.71° | 1.026 | 2.380° | 4.50° |
| 3 | .861 | 1.00 | 2.00" | 21.92° | 1.065 | 4.353° | 8.89° | .847 | 1.381 | 2.762" | 16.06° | 1.055 | 4.454° | 8.96° |
| 4 | .840 | 1.00 | 2.00" | 21.60° | 1.104 | 5.105° | 14.00° | .828 | 1.60 | 3.20" | 13.77° | 1.080 | 5.096° | 14.05° |
| 5 | .820 | 1.129 | 2.257" | 19.07° | 1.126 | 3.010° | 17.01° | .821 | 1.60 | 3.20" | 13.71° | 1.093 | 2.813° | 16.87° |
| 6 | .805 | 1.257 | 2.514" | 17.07° | 1.143 | 2.761° | 19.77° | .815 | 1.60 | 3.20" | 13.66° | 1.105 | 2.795° | 19.66° |
| 7 | .788 | 1.429 | 2.857" | 14.95° | 1.165 | 4.006° | 23.78° | .807 | 1.60 | 3.20" | 13.58° | 1.120 | 3.343° | 23.00° |
| 8 | .774 | 1.60 | 3.20" | 13.28° | 1.188 | 4.247° | 28.00° | .788 | 1.10 | 3.20" | 13.48° | 1.143 | 4.657° | 27.66° |

"END OF TIP TAPER"

"THROAT" (ON "SUCTION" SIDE)

SAWTOOTHED DIFFUSER, VANED, FOR CENTRIFUGAL COMPRESSORS

The obviously drastically new structure or configuration to which my claims are solely confined, has resulted from application of a different design theory, and it is believed that both this application of that theory to vaned diffusers, and the drastically new structure resulting, have heretofore been missed in the approximately 47 year history of vaned diffuser development.

This invention is not limited to so-called pure radial centrifugal compressors whose passages are confined to lie broadly but not meticulously in planes wholly radial and at right angles to the impeller-diffuser axis. The invention applies also to the so-called, in the industry, mixed flow compressor type, wherein it is indeed essential that the passages do have a radial component of their directions of gas travel along the passages, but which passages also have an axial component of their directions of gas travel. The claims herein cover both types, but the mixed flow type is not referred to again in this specification, other than to include it in important definitions given in the immediately following section.

Though this detailed study and its resulting new structure have been confined to subsonic vane-entry at Mach .9, this design approach may be successfully applied to transonic entry vaned diffusers also. No further reference to this possibility is made herein, but my claims are not limited to subsonic entry of the gas. This new structure principle can be applied to transonic entry diffusers also.

Five disclosure documents bearing U.S. Pat. Office Disclosure File No.'s 057500, 058285, 058775, 058823, and 060351 have been successively filed as diligent thought on this same one invention has progressed. The documents are dated from Jan. 7, to Apr. 29, 1977.

Thus, only the fifth document 060351 is complete and completely correct. The earlier ones, except one, may be ignored except to establish priority of art and diligence. The exception: The second document, file no. 058285, plotting only a true vaneless path from transonic entry of Mach 1.4 down through subsonic flow to a very low Mach No. as the basis for starting vane and sidewall design, justifies the statement above on applicability to transonic entry. The last disclosure, file no. 060351, includes a vastly reduced reproduction of my original 7½ foot by 3 foot drawing dated Apr. 17, 1977 with over a thousand words of gtext on it in explanation, repeated and augmented herein. That original drawing is herein broken into five identically drawn small figures without their text words, to meet rules of size, etc. for patent publication. It is available, if requested by the Patent Office.

DEFINITION OF TERMS ESSENTIAL TO PROCEED FURTHER

Three professionally established diffuser geometry terms appear herein again and again, with and without quotes added by me.

Heretofore each of these terms without my quotes added frequently herein, has literally represented an aerodynamic truth, still true herein for the latter portion of vanes and passages, only. But when quotes are used herein, the terms no longer have any aerodynamic significance in this design, only, and the quotes substitute for frequent repetition of the word, "so-called", still used only in the claims; no quotes are used in the claims, lest they be misunderstood and limit breadth of claims, to which these established terms do apply when describing structure, not necessarily aerodynamics.

Suction or "suction" side means the radially inner side of any vane.

Pressure or "pressure" side means the radially outer side of any vane.

Throad or "throat" means the cross section of a passage from a vane tip across to the suction or "suction" side of the next outwardly adjacent vane, that throat cross section being as normal as possible to all vane-sides of the passage. (Opposite-wall-divergence or convergence angle, either of side-walls or vanes, usually prevents that throat cross section from having meticulous normality with some or all of the 4 passage walls.)

A fourth term, so-called mixed flow, is used in the claims herein, and in this Abstract of the Disclosure, only. The mixed flow type of centrifugal compressor is one whose passages do not lie in planes broadly but not meticulously wholly radial and at right angles to the impeller-diffuser axis, but instead at least a portion of impeller or diffuser passages, or both, do have radial, but also axial components of direction.

BACKGROUND OF THE INVENTION

Theory shows (see pages 30 to 35 herein, per E. S. Taylor ref) that the log-spiral with heretofore conventional side-walls does not represent an inviscid, steady-state source-vortex flow path in a vaneless diffuser. Further, the weight of experimental evidence researching annular vaned diffusers having log-spiral vanes with conventional side-walls, is that the isobar at the throat is normal or nearly normal to the vanes. (Also, irrelevant here, it is normal with straight passages, per theory.)

On the other hand, for steady-state inviscid flow, the isobar at the entrance to a vaneless diffuser is a concentric great circle about the impeller-diffuser center axis, that is, extremely oblique to the flow direction there.

Thus, this means that there has existed for about 47 years, an abrupt deflection of the gas flow direction by one side of the vane or the other or both, in a very short distance, in effect a shock-treatment, sub or supersonic, which creates a loss in efficiency of the diffuser as a whole.

This inventor has long maintained that if one could only achieve highly oblique isobars at the throat, then one could design for a gradual transition from the then resulting highly oblique isobar at vane-tip circle to a normal one near the passage exit, for much more gentle treatment of the high velocity gas, resulting in higher efficiency overall of the diffuser.

The purpose of this invention is to achieve such highly oblique isobars at the "throat". That is now accomplished herein, resulting in a most obviously drastically new and different structure, on which structure only, the claims herein are based, the claims not written on the theory which alone begets this structure, though that theory is fully disclosed herein.

The example of design computed herein is for inviscid steady-state flow only, thus not making allowances for the heretofore experimentally established deleterious effects on performance of viscosity and unsteady flow. Nevertheless, this inventor maintains that this structure is a more rational starting base from which to make, or learn, those added allowances. Heretofore, research has not started with vane and side-wall structure representing in the first place, an inviscid steady-state source-vortex path in a vaneless diffuser. It is possible that those deleterious effects of viscosity and unsteady flow on performance may be found to be less than heretofore long established by experiment.

SUMMARY OF THE INVENTION

Unlike prior diffusers, in the design herein there exist no pressure nor suction sides of a vane until the "suction" side is past the "throat". And herein, that "throat", when operated at the design point of volume flow rate per impeller RPM. has no aerodynamic significance, only the fact of structural existence. This is because the gas is not deflected by any vane until past the "throat". Both sides of a vane, or to be meticulously correct, the boundaries of its two boundary layers, starting at its tip, follow respectively two different source-vortex, i.e., vaneless diffuser, spiral paths achieved by computed, scheduled, wide variations of diffuser width, by varying rate of wall-divergence and resulting vane-side width, within each individual passage from its "pressure" side to its "suction" side, in combination with the new vane configuration required also. (See FIGS. 1a and 2a.)

Since this side-wall divergence of one individual passage from a narrower "pressure" side to a wider "suction" side, is repeated for each individual passage until the "suction" side is past the "throat", in this radially inner region of the whole diffuser a radial cross section across more than one passage is sawtoothed in appearance. Hence, its name: "Sawtoothed diffuser, vaned."

On arriving radially outward at a certain radius great circle about the impeller-diffuser center axis, (Circle U-U in FIGS. 1*a* and 1*b*) both sides of the same vane have become of equal width again at their now wider widths, (see FIG. 2*a*) and thus the sawteeth have disappeared, the sidewalls thereafter continuous to the O.D. per ancient practice, and may be made parallel, diverging, or converging, and curved or flat radially, at the will of gthe designer, also per ancient practice; but in addition, a drastically new structure of the above described initial portion sawtoothed side-walls, and new vane shape, both essential for this design, constitutes this invention.

The intended ultimate contribution to higher efficiency made possible by this invention, but not claimed as a part of it, is that by proper design of the vanes and side-walls following the earlier invented portion of vanes and side-walls, which creates oblique isobars at the "throat" for the first time, the transition from these early oblique isobars should be made gradually to normal isobars at or before the passage exit. Heretofore, all isobars have been normal from throat to exit. One means of accomplishing this latter portion of vane and continuous side-wall design preceeded by early oblique isobars, has been published and copyrighted by the inventor (1975). Suggested, but non-computed, vane contours after the invented early portion of this diffuser are drawn, and discussed more briefly herein.

BRIEF DESCRIPTION OF DRAWINGS

The five drawings herein constitute an accurately broken-up version of the original and identical 7½ foot × 3 foot drawing representing this invention as to lines. Obviously, patent publication size requirements dictate this break-up and vast reduction of the original 4x-scale-of-a-10inch-diameter-vane-tip-circle, original single large drawing.

FIG. 1*a* represents one typical sector only, of the whole diffuser of 13 vanes, in which sector the entire invention structure is disclosed, but repeated of course in the other identical sectors of the annular diffuser, not drawn.

FIG. 1*a*, is used partly and more briefly in discussing my non-computed here, examples for the remainder of vane and side-wall configuration to the O.D. This is not claimed as a part of the invention, because the substance of its text was already published by me in 1975, but it is an essential different principle of approach to the 2nd-half-of-vane and-side-wall design, if the much higher efficiency made possible for the first-time by this early-oblique-isobars invention, is to be made a reality, else less advantage from the invention, than to be had without it.

DESCRIPTION OF THE INVENTION

This portion of the specification is in three major sections:

A. Because the claims are written solely on the radically different structure which must result if application of the theory and its mathematics is followed, the new structure is described here first, with reasons for it postponed to section B, following.

B. The theory and its application to design, the resulting design problems and limitations, plus pre-rebuttals to anticipated possible arguments by designers of conventional diffusers, are discussed here at length.

C. The published E. S. Taylor mathematical determination of any true vaneless path, without which this vaned diffuser concept, original with this inventor, could not have been consummated quantitatively to assure its validity.

A. New Structure Description Only, Without Reasons

This in turn is in two parts:

1. The sidewalls compared with sidewalls heretofore.
2. The vanes compared with vanes heretofore.

1. Sidewalls: Heretofore the inner sidewalls of vaned diffusers have been smoothly continuous along a radius from the impeller-diffuser center axis across the entire diffuser from vane tip circle to the O.D. These have been either flat or curved along a radius, but smoothly continuous; and they have been parallel, diverging, or converging, but smoothly continuous, except where interrupted by vanes across.

Figure 1A:
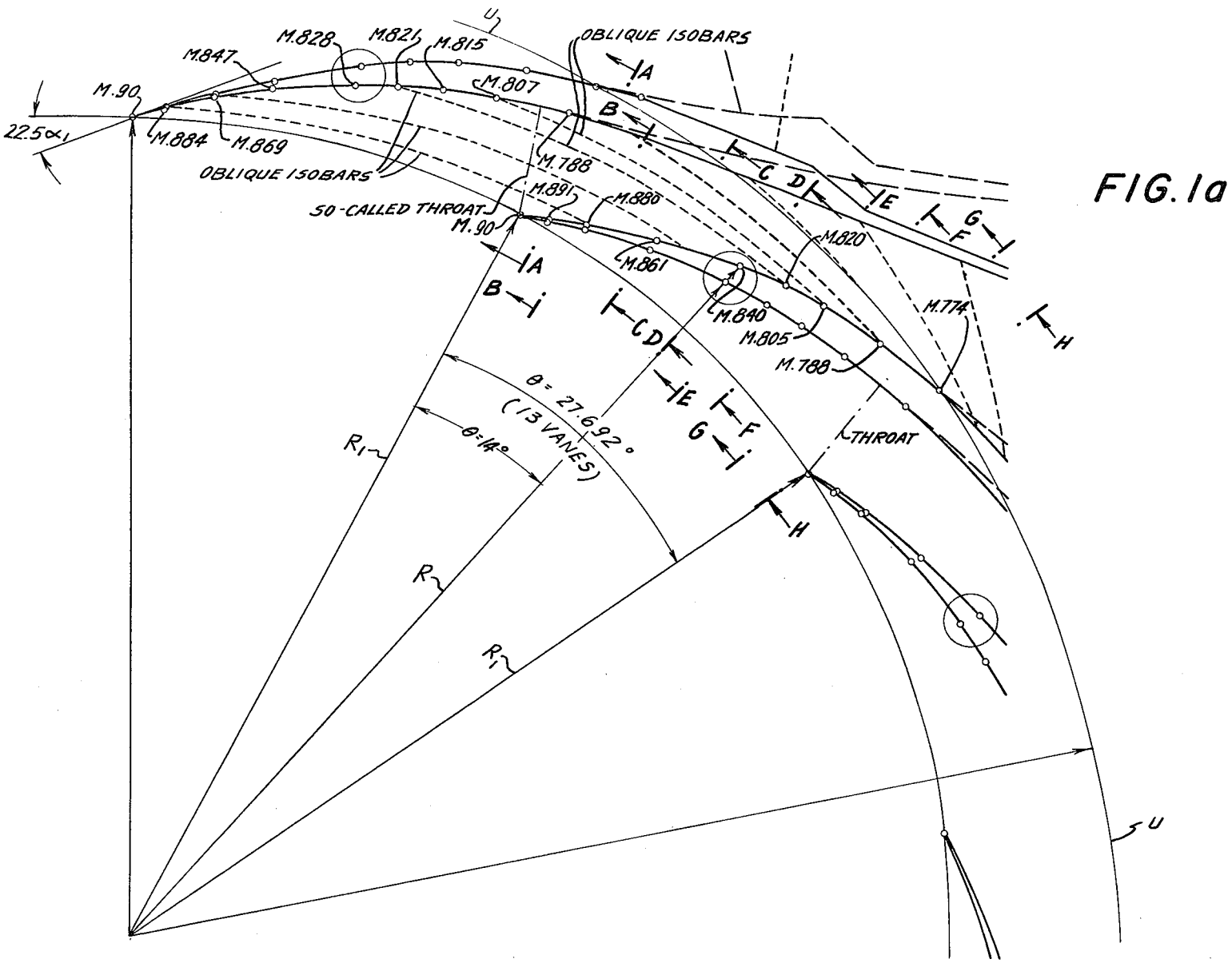
FIG. 1a is essential in discussing at length, together with its accompanying cross section counterpart FIG. 2*a*, the extensively computed vane and its essential accompanying vane widths and side-wall contours.
Figures 2A, 3:
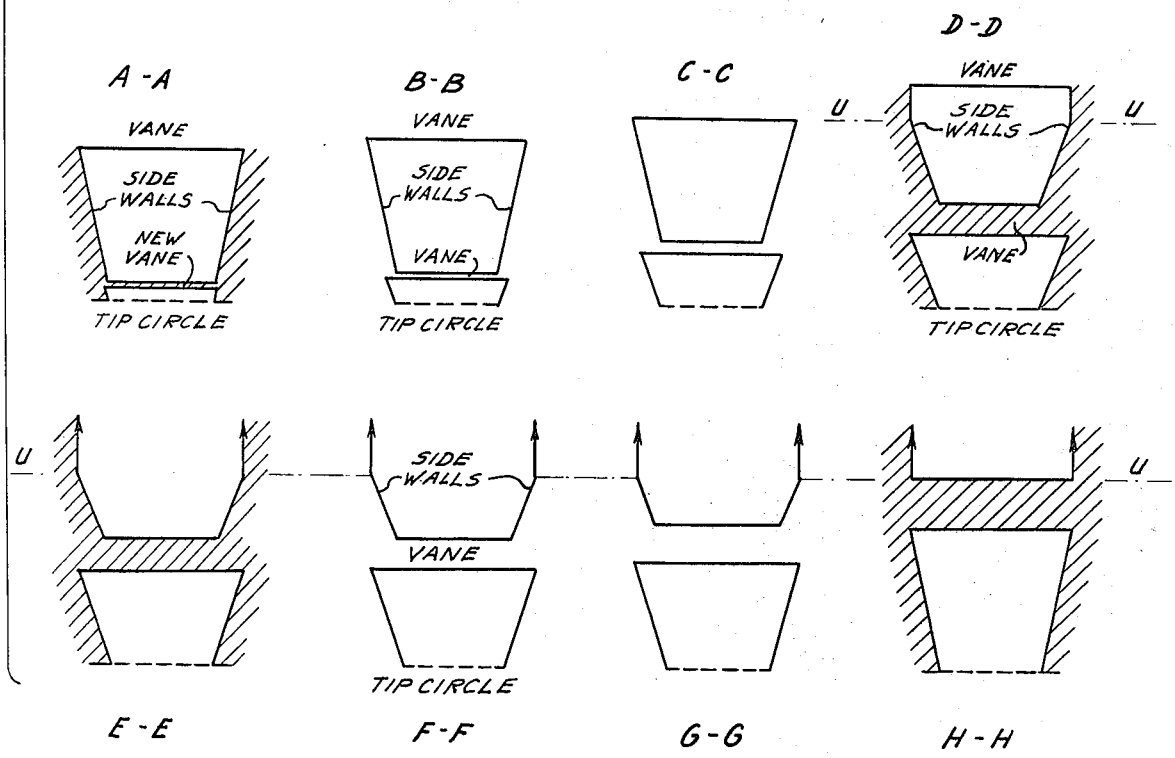
FIG. 2*a*, Sectiona A-A to H-H, is the essential section view counterpart of FIG. 1*a*, the invention not extending beyond this portion of the diffuser, other than continuing to repeat in FIG. 2*b* the same invention as applied to succeeding passages as more vane-tips appear on the tip circle, better to comprehend the diffuser over a larger sector of all of it.
FIG. 3, discussed only briefly herein, is a table of the end results of the computations by extensive trial and error, pre-establishing all the essential dimensions, degrees, and ratios, of both vanes and side-walls of the invented portion of the diffuser to which values all of the 4 preceding figures have been accurately drawn.
Figure 2B:
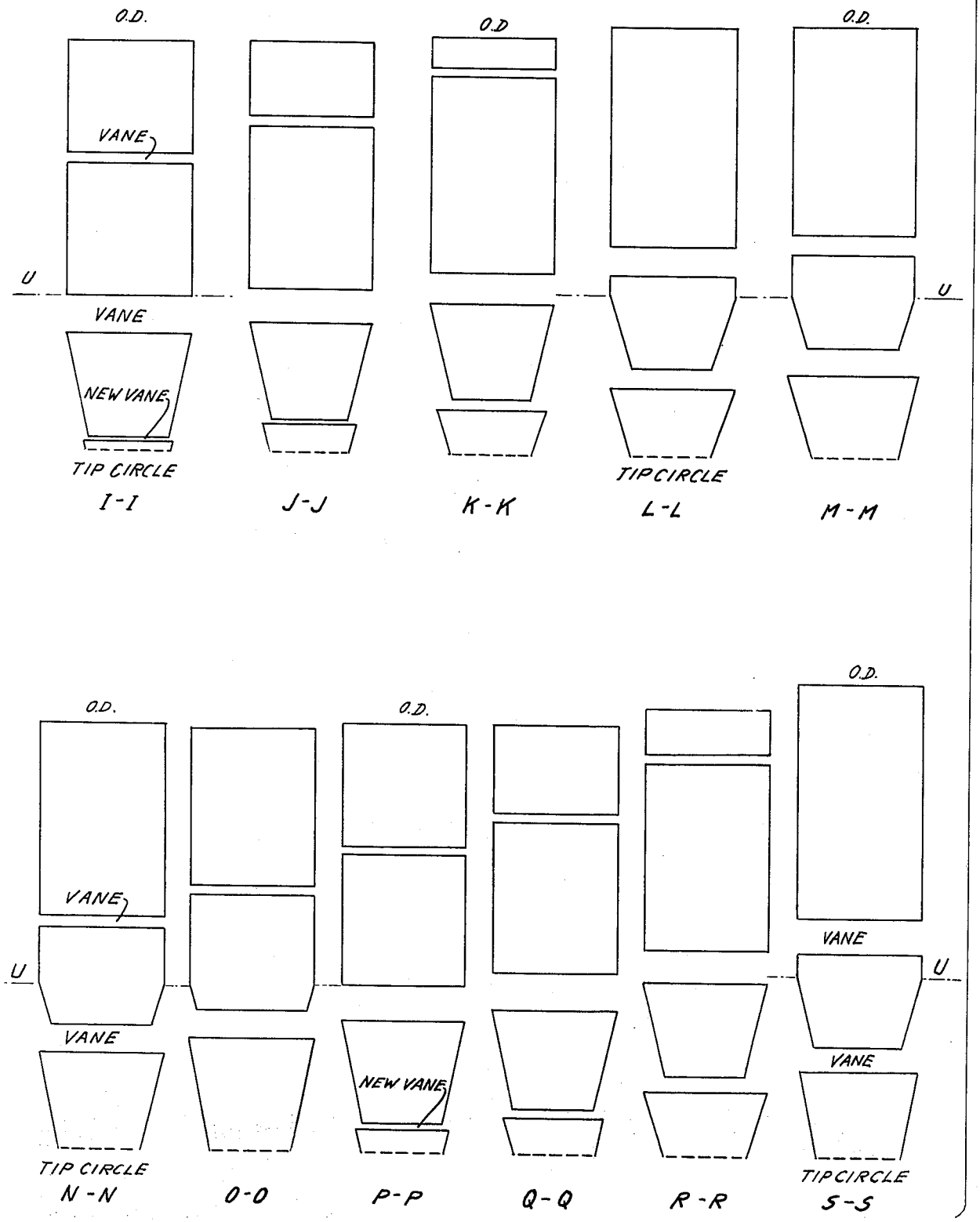
FIG. 2*b*, the passage cross sections I-I to S-S, is used in two ways: (A) Essential counterpart of FIG. 1*b*, carefully explained under FIG. 1*b* above; (B) to help visualize a larger sector of the hole diffuser.

But in the invention herein as indicated by the sections of FIGS. 2*a* and 2*b*, the inside side-wall surfaces are sawtoothed passage-to-passage at the radially inner diffuser diameters sectioned along a radial plane parallel with and intersecting the impeller-diffuser center axis; those sidewalls then become continuous to the O.D. per ancient practice for whole diffusers, but here only after arriving outside radially of a certain intermediate diameter great circle about the impeller-diffuser center axis. (Circle U-U, FIGS. 1*a* and 2*a*.) That is, at first each individual passage has its inner sidewalls diverged radially outward from narrower diffuser width on its inner or "pressure" side to wider on its outer or "suction" side, until the passage is past the "throat", creating a sawtoothed appearance of these radial sections taken across the inner sidewalls when taken across more than one passage, until that intermediate diameter great circle is reached. These sawteeth increase in toothdepth from zero at the vane tips to a maximum depth relatively early along the passage, then decrease in depth to zero again upon arriving at the said intermediate diameter great circle U-U.

It is believed that this is radically new structure for a diffuser.

2. Vanes: Over about 47 years of vaned diffuser development, both research literature and physically consummated diffusers have resulted in many vane configurations, very broadly listed as follows:

The spiral constant-thickness vane, log-spiral at its beginning.

The straight-sided vane, increasing-thickness in the direction of gas travel.

A bulged-sides straight center-line vane, of variable thickness.

A vane with one side straight, the other concave near the tip, becoming straight, the vane increasing in thickness with gas travel.

An exaggerated form of the latter, called the island-vane.

Two or more annular concentric rows of cascaded airfoils, those of one row staggered, not aligned, with respect to those of the next outwardly adjacent annular row.

The "pipe" diffuser, wherein straight, diverging outwardly, round passages are drilled in an annular metal block, replacing former vane passages, the structure claimed to result in helpful aerodynamic treatment at the entering ends of each "pipe".

Now, all of these have failed, in later decades failed in full knowledge of the designer that they would fail, (except the intended purpose about 1930 of Dr. Sanford A. Moss of the General Electric Co., but which too failed, in originating his constant thickness spiral vanes) .... failed to take advantage of the laws of source-vortex flow demanding two different spiral paths respectively suitable for each side of the vane, if that normal isobbar across the throat were to be avoided.

This failure is because, possibly, that between two and three decades ago it became accepted by fluid-flow researchers apparently universally, that a normal isobar "had to exist" across all vaned diffuser throats, no matter how designed; thus in practice, designers continued to adhere to or to invent, the above listed vane types in full knowledge that none would eliminate that normal isobar across the throat.

FIG. 1a shows that the vanes of this invention, though spiral once again, are rapidly thickening from the sharp or substantially sharp tip until unusually thick until well past the "throat" , not constant-thickness spiral vanes nor increasing thickness straight vanes. Further and essential, FIG. 2*a*, sections AA to HH show that starting at the tip where the two vane sides are naturally of the same width, the vane "suction" side increases in width along the vane to a maximum, then holds that wider width constant for a further distance; while conversely the "pressure" side width of the same vane is held constant at its tip width about until the "suction" side has reached that maximum width. (See Section D-D of FIG. 2*a*, the vane separating two passages), when then the "pressure" side begins to increase in width until at a certain radius great circle about the impeller-diffuser axis, (circle U-U for this design) both vane-side widths have become equal again as at the tip, but now at the wider width. (See Section H-H of FIG. 2*a*, where a vane separates the two passage sections shown there.) And thus, for each individual passage, repeating passage-to-passage, the passage cross sections A—A to G—G of the upper passage of FIG. 2*a*, are all trapezoidal, or partly trapezoidal in shape, until far past the "throat" of a given passage where the cross section has become rectangular at that particular station (Section H—H, outer passage there); but not necessarily continuing rectangular thereafter, optional with the designer.

Thus this diffuser structure, both sidewalls and vanes per FIGS. 2*a* and 1*a*, respectively, is obviously drastically new and different than seen or suggested heretofore.

B. The theory, its application generating this structure, plus design limitations and problems; and some rebuttals yet unasked, to possible objections by designers of conventional diffusers.

Basic explanation of design of a vaned diffuser, the early portion of which is based on two different true vaneless paths.

In a vaneless diffuser with steady state inviscid flow, the isobars of the main flow (exclusive of its boundary layer formation) are concentric circles about the impeller-diffuser center axis, that is, they are oblique to the flow direction. Station points along the gas paths in a vaneless diffuser, and likewise if vaned by my vanes only, which vane-sides at first follow those true vaneless paths and have no deflecting influence on the gas, are superficially located by the elementary calculus coordinates of any spiral, namely two, the radius ratio $R/R_1$ and the central polar angle $\theta$, of each station. $R_1$ is the radius from the impeller-diffuser center axis to the entry great circle of the vaneless, or to the tip circle of my vaned diffuser, and R is the radius to the station sought on the spiral. $\theta$, is measured for a vaneless path station, from a base $\theta = 0$, at some point on the entry great circle of radius $R_1$ and in the case of my "vaneless" vanes, $\theta = 0$ at the vane tip concerned, on the $R_1$ circle.

But less superficially, vaneless paths, as well as my diffuser early vane-sides only, are described and determined by the following mutually dependent variables defined here: (For detail, see sub-section C.)

Mach number at the station on the spiral path, $M_1$ being that given at the vaneless entry $R_1$ circle or at my vane tip on the $R_1$ circle.

Ratio of widths $h/h_1$ between sidewalls of a vaneless diffuser at a station, and therefore widths of my vane-sides there, to width between the sidewalls at the vaneless diffuser entry circle, or at the entering tip of my vanes lying on that $R_1$ great circle.

The ever-declining spiral angle $\alpha$ at successive stations along the spiral, between tangent to the spiral path and tangent to the great circle of radius R there, about the impeller-diffuser center, $\alpha_1$ being that angle entering at the $R_1$ vaneless circle, or the vane tip angle if my vanes are installed in the vaneless.

$R/R_1$, defined above.

$\theta$, central polar angle defined above.

$\Delta\theta$, Station-to-Station incremental $\theta$, used for finite integration steps successively to locate stations on any spiral, per the elementary calculus equation for any spiral. (see sub-section C.)

The steepness of the vaneless diffuser spiral path, i.e., the magnitude of its varying angle $\alpha$, is determined partly by sidewall divergence rate, i.e., by the variation with radius, of the vaneless diffuser widths. The more rapidly the sidewalls diverge with increasing radius, the flatter the spiral, i.e., the lower the angles $\alpha$ of the path which the gas itself seeks out without any vanes present, and thus also, even if my non-deflecting, non-influencing early-portion vanes are present.

Now, the most challenging item of the design is that a tip taper is necessary to reach in a reasonably short travel distance from the sharp or substantially sharp tip, a conventional vane thickness for reasons both of fabrication, and vane strength under elevated temperatures. And since per this theory dictating, both sides of that tip taper must lie respectively on two widely different vaneless or source-vortex spiral paths, the sidewalls of each individual passage must be diverged, so that that "vaneless" diffuser width shall be narrower along the vane "pressure" side of the tip taper, than along its "suction" side. There are limitations both ways to achieving a tip taper which thickens to a minimum required thickness within a short enough tip taper, namely: too long a taper makes for too long an extremely thin short portion of the vane close to the tip, since both sides begin at the same entry gas and vane angle at the very tip, substantially sharp; on the other hand to achieve a shorter tip taper, thus shortening the undesirable thin short portion close to the tip, a larger sidewall divergence angle of each individual passage is required, perhaps proving unacceptable to fluid-flow scholars in regard to flow-separation of the gas from the sidewalls of a diverging-wall vaneless diffuser.

Per FIG. 1a showing the chosen result for this particular design, of a series of trial and error vane taper design studies, the minimum desired vane thickness has been satisfied at the circled 4th stations after the tip, at a $\theta$ of about 14°, about half-way to the "throat", which is at about 28° $\theta$.

But it should be noted that though this circled point of travel along the vane ends the tip taper required for structural reasons, nevertheless the vane thickness continues to increase drastically after that point. This continuing thickening is not sought per se, it is dictated by the mathematics of establishing after that commitment, the then 2 continuing different source-vortex path vane-sides on opposite sides of the same vane.

Nevertheless, establishing first the required, but misnamed, "end of tip taper" (circled at 4th stations of FIG. 1*a*) is a challenging and highly governing factor of the whole diffuser design, which insists upon source-vortex-path tip vane-sides, yet simultaneously insists upon achieving a practical tip-taper shortness for fabrication and strength reasons.

Now, one feature of this invention is a means of minimizing that continuing vane thickness-growth beyond the misnamed "end of tip taper" station, beyond which further thickness increase is not particularly sought, simply dictated by the equations for true vaneless paths.

FIG. 2a shows that until the misnamed "end of tip taper" station (circled in FIG. 1*a*) the "suction" side of the vane has been getting wider and wider for 4 stations to section D-D from the original tip width by divergence of its passage walls with increasing radius of the spiral. Conversely, until that station the "pressure" side of that same vane has been held constant at the same width as at the tip circle. (Sections A—A to H-H will be discussed in detail shortly).

At this misnamed "end off tip taper" point, the "pressure" and "suction" side vane width-growth schedules are reversed, the "suction" side thereafter being held constant at its new wider maximum width, but the "pressure" side at that circled station, till then held constant at the relatively narrow tip width, begins to widen until station 8 just past the "suction"side passage "throat", both "pressure" and "suction" side of the same vane have there arrived at about the same max width.

This is not to be confused with the "pressure" side of another vane bounding the directly opposite side of this "suction side"-bounded passage. That "pressure" side just after the "throat" located at its own tip, is still being held constant at its narrower width than the "suction" side for four more stations of that passage, and finally reaches max. width at its own 8th station from its tip, far beyond its own "throat".

Thus, considering now the "suction" and "pressure" sides of the same vane, the sawteeth have disappeared just after the "throat" bounded by the "suction" side, i.e. that vane has reached the radius circle at which source-vortex flow is terminated. (Circle U-U in FIG. 1*a* and 1*b*). And, as stated before, the sidewalls beginning at that radius circle (8 stations of this design after any tip) are continuous, not sawtoothed, thereafter to the O.D., but are not necessarily flat nor parallel as per FIG. 2*b* which is only used as an example herein. That choice is optional to the designer.

Next, considering the passage bounded on the outside by the "suction" side, (not both sides of the same vane,) until the "suction" side at station 8 (in this design) is just past the "throat" of the passage it bounds, and until the "pressure" side at its own station 8 bounding the other side of that same passage, whose station 8 is naturally far past that same "throat" (see FIG. 1*a*) (because its "throat" is located at its own tip of the new "pressure" side), the isobars are highly oblique to the flow, i.e., nearly concentric circles about the impeller-diffuser center axis, substantially as in a vaneless diffuser.

Mentioned qualitatively earlier, in FIG. 1*a* a great circle U-U is drawn about the impeller axis center through station 8 of the "pressure" side. Beyond this circle and only when this circle is reached at greatly different distances of travel past the "throat" along the 2 vane-sides bounding a passage, source-vortex flow is discontinued and the designer may now configure his vanes and his thereafter continuous side-walls so as gradually to convert the oblique isobars from being highly oblique until that radius, to finally normal across the passage at or before the exit near the O.D. of the diffuser.

FIG. 2*a* shows 8 cross sections A-A to H-H located by their corresponding section lines on FIG. 1*a*, of two early adjacent passages separated by a vane. The bottommost passage shown is boundaried on its radially inner side by the open constant-width vane tip circle, i.e., the $R_1$ entrance great circle to the diffuser. The straight section lines A-A to H-H shown in FIG. 1*a* are radial and thus though substantially normal to the bottommost passage shown in FIG. 2*a*, they cannot be also normal across the next outwardly adjacent one, obviously.

In This FIG. 2*a*, the rapid thickening of the vane separating the two passages is again evident in the sections A-A to H-H.

In Sections A-A through D-D of FIG. 2*a*, from the tip and to the misnamed "end of tip taper" at D-D, the "suction" side of the vane will be seen, as stated above, to be increasing in width at successive stations until it has reached its maximum width at Section D-D, needed to accomplish the required vane taper maximum thickness at section D-D while still lying on a "vaneless" path.

But the outer or "pressure" side of that same vane on the other hand, is held constant at tip-width until section D-D (circled stations FIG. 1*a*). Thus, along a radial section the inner sidewall surfaces are discontinuous in this region when more than one adjacent passage is sectioned, creating a sawtoothed appearance of cross sections because of differing widths of the two sides of the same vane, the "tooth" depth reaching a maximum at section D-D the misnamed "end of tip taper" location.

This has been necessary for the two sides of the same vane to lie on two highly diverging vaneless path spirals from the vane tip until soon as possible, thereafter, accomplishing an acceptable, adequate vane thickness within a reasonable travel distance along the vane, yet contributing no deflecting influence on the two self-seeking vaneless gas paths along the two sides of the same vane.

The variable ratio $h/h_1$ in the tip taper part of the vane, of the "suction" side width to the "pressure" side width, is first selected for the "end of tip taper" station (circled in FIG. 1*a*) by initial studies; in this design this width ratio there was finally selected as 1.6. Then for this design, the width ratio was made to grow linearly with travel from the tip, from a ratio of 1.0 at the vane tip to the "end of tip taper" station, i.e., width ratio growing linearly with central polar angle $\theta$.

In FIG. 2*a* the remaining four sections E-E to H-H of the continuing source-vortex passage after section D-D at the "end of tip taper" station, are also shown. Looking at the vane separating the innermost and outermost of the two passage sections of FIG. 2*a*, the already-mentioned constant max "suction" side width of that vane at D-D, is evident in sections E-E to H-H, as is now the growing width of the "pressure" side of that same vane bounding the outwardly adjacent passage of the two passages.

Also, evident in sections E-E to H-H of FIG. 2*a*, of the outermost of the two passages is that by section H-H the two sides of the separating vane have arrived at equal and wider width, the sawteeth have disappeared, and the section of the outer of the two passages shown has become rectangular at that station, from wholly trapezoidal or partly trapezoidal before, in the preceding sections AA to GG.

More in detail, in the sections of FIG. 2*a*, the outer of the two passage sections, beginning with section D-D the passage section has begun to cross radially outwardly the aforesaid great circle U-U, where maximum width is reached, and thus sections D-D to H-H are becoming less and less trapezoidal and more and more rectangular, their section side-walls consisting of both diverging side-walls at lesser wall radii, and parallel at greater wall radii, intersecting at that great circle U-U, until at section H-H the outer section shown is wholly outside of that circle, and the walls are wholly parallel for a rectangular section there. Thereafter, the sections of that same passage need not remain rectangular; they may revert to trapezoidal depending on the will of the designer whether to retain his thereafter continuous walls parallel until the O.D., or diverge or converge them, and whether to design them flat, or continuously curved on a radial section. In this particular design, option "X", discussed later and sectioned to O.D. by sections I-I to S-S of FIG. 2*b*, parallel walls were selected as an example, thus continuing all sections rectangular after H-H, after the source-vortex flow was discontinued at the 8th stations from tips on both vane sides, but that choice is optional, and is not a part of this invention.

In FIG. 1*a*, the section line H-H also shows that the FIG. 2*a* innermost passage of section H-H is located on average just past the "throat" of that passage, the H-H section line of FIG. 1*a* passing through the newly arrived vane tip on the tip circle.

Figure 1B:
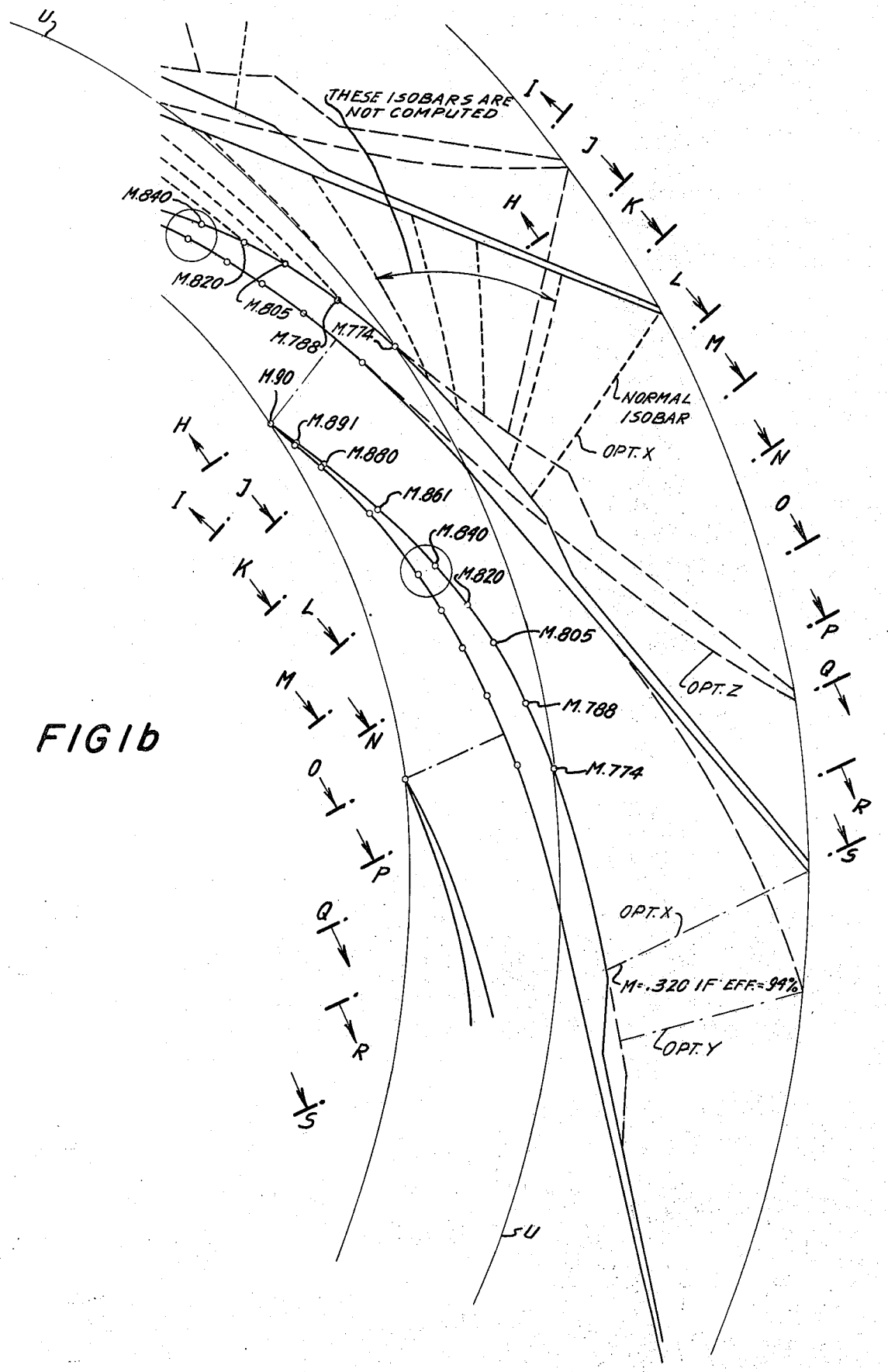
FIG. 1*b* overlapping considerably

In FIGS. 1*b* and 2*b*, this same passage, till here the innermost passage, now because of the arrival of that new vane, has suddenly become the second innermost passage from the vane tip circle, and its cross sections H-H through I-H and on, continue to be trapezoidal for several stations past the "throat", until at section L-L, of FIG. 2*b*, they have again begun to cross radially the great circle U-U where maximum width is attained. Here the part-trapezoidal-part-rectangular cross sections of this passage again begin to appear, becoming wholly rectangular at station P-P, far past that "throat" on the "pressure" side, namely, at the 8th station after the "pressure" side tip.

Meantime, the new innermost passage from the vane tip circle repeats the configuration already discussed under FIGS. 1*a* and 2*a*.

FIG. 3, is a table of end results of computation of vane and side-wall design values, a lengthy trial and error process, and may now be inspected, but by now it is redundant from geometrical and theory understanding. Rather, it indicates that all these varying dimensions and degrees and ratios discussed above, have been drawn strictly and accurately in accordance with a precomputed design study.

Recorded in FIG. 3 for each of 8 stations on the "pressure" side and 8 stations on the "suction" side of a vane, are the values of Mach No., vane-width ratio $h/h_1$ vane-width in inches, $\alpha$, $R/R_1$, $\Delta\theta$, and $\theta$.

A double line drawn across the table after the 4th stations counted after the tip demarcates the misnamed "end of tip taper" discussed at length above and circled in FIG. 1*a*, at which station (section D-D of FIG. 2*a*) the two schedules of widening "suction" side and constant width "pressure" side are reversed, the "suction" side thereafter to station 8 held at the constant wider width, and the "pressure" side thereafter beginning to widen to the 8th station, (Section H-H of FIGS. 1*a* and 2*a*), where both sides of the vane are again equal in width, at which point the source-vortex flow portion is completed. (And so is the invention as claimed).

A second double line is drawn across only the right side of the table pertaining to a vane "suction" side's values. This implies that the "throat" as located on the "suction" side only, occurs just before the 8th and last station for the source-vortex, or vaneless, gas path to exist. Not so, as discussed above, the location of the "throat" on the "pressure" side of a vane, whose "throat" is at its vane tip station of the table.

Reward from, and necessity of, the above complex configuration:

To remind again, the object of all this complication is to have oblique isobars across the "throat". Referring to the uppermost passage of FIG. 1*a*, the calculated station Mach No.'s along those 2 passage vane-sides are recorded there. Each isobar shown is plotted as terminating each of its ends at identical Mach No.'s from that one isobar. Note that the isobars are highly oblique to the normal "throat", (replacing a normal isobar there), from the outermost tip at the left, on across 100% of the "throat" cross section, thus meeting the objective of this invention.

Anticipated Arguments and Pre-Rebuttals:

Before proceeding to briefer discussion of the vanes, walls, and passages after source-vortex flow has been terminated in this design after the 8th stations after the vane tip, not claimed as a part of this invention, herewith are presented several pre-rebuttals as yet unasked, to possible first objections to this disclosure by designers of heretofore conventional diffusers.

1. It will instantly be noticed that for a few stations after the "throat", normal passage cross section areas decrease with travel along the passage for a few stations. For heretofore diffusers, this is "sacrilege". Heretofore a subsonic diffuser passage has always had to expand its normal cross section areas with gas travel along its passage.

This disregard of that old requirement is defensible on two counts:

a. The minor defense: My report self-issued in 125 copies of October, 1975, stated that with entering oblique isobars, effective passage areas are: the product of the oblique isobar length times the sine of the angle $\gamma$ between isobar and main flow direction, times the diffuser width. And that use of normal cross sections with early oblique isobars would be fallacious design. Normal cross sections of properly designed passages with highly oblique early isobars can, decrease with travel along it. Normal cross sections are no longer meaningful as effective areas, when the isobars begin oblique. Their past use in design has always been correct because it was for heretofore always normal isobars throughout the passage. The oblique isobars begin very long, and sine $\gamma$ begins very small, the very long isobars greatly shortening, the very small sine $\gamma$'s greatly increasing, with travel along the entire passage, and their product varies in an unexpected manner.

b. The major defense: both vane-bounded sides of the passage herein lie on, or one side has just begun to lie outside of (after section H-H of FIG. 1*a* into 1*b*) two different vaneless spiral gas paths (source-vortex flow paths) with highly oblique isobars across the passage.

Envision a vaneless diffuser designed to have successively outwardly, first parallel, changing to diverging, side-walls. The spiral path in these two portions of the vaneless diffuser have widely different degrees of steepness, i.e., their $\alpha$ angles, the outer path in the diverging portion corresponding to our "suction" side herein, having for this particular design an angle of 13+° and the path in the inner or parallel vaneless wall portion corresponding to our "pressure" side, having an $\alpha$ of 22° to 21°. These two paths are bound to converge, yet diffusion is proceeding nicely. This is because the gas has freely selected its own path, that is its own Mach numbers, its own corresponding $\alpha$'s, $R/R_1$'s and $\theta$'s at each station of both different spirals.

Thus, when wholly non-deflecting vane-sides lying on exactly these spiral paths are introduced into such a vaneless diffuser, the gas is "unaware" that they exist, and diffusion is still proceeding nicely.

The use of normal passage cross sections in this design would be irrational and wrong, because the gas is following the flow laws of vaneless diffusers, nothing else.

2. Another possibly-to-be questioned feature of the design herein needs to be discussed, namely, why only 13 vanes?More vanes are usually contributing to a lower exit Mach number within a limited diameter allowed, partly because with few vanes, we have less utilization of the available but limited diameter, when the vanes are farther apart at the exit, the last isobar being normal across the passage there.

The design challenge which may, or may not, limit us, is at the other end of the passage, as explained at length in re vane tip taper design, above.

In the design herein, the maximum radial half-divergence angle of the two walls in the sawtoothed portion is 20.5°, but since the flow along the sidewalls of the spiral paths is very far from radial, the real flow half-divergence angle along that path is only 6.2° maximum. This is well within Creare Inc.'s published finding that 7 degrees half-divergence angle in a straight diffuser tube seems to carry no flow-separation price with it.

Needed, is knowledge from fluid-flow separation researchers of how much wall divergence angle of a vaneless diffuser is too much, for avoiding separation of flow from the walls. Now, if experts of flow separation will approve a higher vaneless wall divergence angle than this designer's vaneless wall divergence angle, than we can have more vanes, closer vane-spacing, overcoming the attendant disadvantages just discussed. But this design was made respecting Creare Inc.'s highest-tested 7° of divergence half-angle in a straight diffuser tube.

This in turn has restricted the number of vanes to about 13, because if closer spacing, the maximum side-walls half-divergence angle would have to be higher than my chosen limit to achieve the present modest length of required vane taper, yet still have its "suction" side line on a true source-vortex path, the first requirement of this design concept.

3. Related to this maximum permissible number of vanes is the width of diffuser vane tips and accompanying impeller tip width.

Just as the maximum allowable wall divergence angle limits the number of vanes, so does it limit the width of vane tips. Per the Taylor equations of section C below, the rate of width increase of the "suction" side of the vane from the tip is a matter of width ratio to the tip width, not divergence angle. Thus, selection of a narrower tip reduces wall-divergence angle required for the same width ratio. One must not make the tips too narrow on two counts, (1) impeller efficiency considerations; and (2) not to stray too far from Creare's published quite-flat-optimum throat aspect ratio of 1.0. (That is, if that limitation indeed still applies for this principle of design; it may well not apply.)

This design calls for a relatively narrower vane tip and resulting impeller tip width than currently usual in design, but other considerations may well acquit this unconventional narrower tip width feature as compared with current practice, as follows:

Though this inventor was perhaps the first to publish (1945 SAE Trans., roughly confirmed until this invention,) that the "about optimum" entering vane tip angle $\alpha_1$ should be about 15°, that angle is found not desirable, perhaps not possible, with this design principle. More radial room is needed between adjacent vane early portions to avoid the practical vane tip taper limitations discussed eariler. Hence, the project was redesigned for an entering tip $\alpha_1$ of 22.5 inches. This does call for a narrower impeller tip.

In defense of 22.5° $\alpha_1$ vs 15°, it is probable that Runstadler's published data on throat blockage which indeed currently has such deleterious effect universally on performance, has been the underlying cause of that old experimentally determined "about optimum 15° $\alpha_1$." But for this design principle, when operating at design point of volume flow per Impeller RPM, published throat blockage may be highly exaggerated, because the tip entry gas is not deflected by either side of the vane tips, with boundary growth thus minimized thereby. Thus, throat blockage for this design approach only, may be almost nonexistent and thus have lost signficance herein. Thus, it may well be that there is no price in diffuser performance for 22.5° $\alpha_1$ or some other $\alpha_1$ higher than the former "about optimum 15° " when using this design principle.

As to impeller efficiency with narrow tip, published research including this inventor's (1945), showed that for impeller alone (not overall of the diffuser too) narrow impeller tips gave higher efficiency. This design has not gone to a narrower impeller tip than those once-tested narrower impeller tips.

4. Referring to the radial sections drawn in FIGS. *2a* and *2b*, the sidewalls of each passage have been drawn as flat, not convex nor concave. Academically, this is false, they are very slightly convex in this particular design. But this was studied, and the discrepancy found too small to draw, even at 4x scale of a 10 inches tip circle diameter.

This occurs because the flow paths along the sidewalls are not straight lines, they are curved, namely, spirals. Thus, making station-to-station vane-width growth increments linear with $\theta$ increments, distance along a vane cannot be linear with $\theta$ too, quite.

And further, even if (perhaps a better approach), distance increments along the vane instead of $\Delta\theta$'s were made the criterion for llinar vane-width growth, an incremental distance along the beginning steeper end of the spiral vane has a larger radial component than an equal incremental distance along the flatter end of the spiral, for a lower wall-divergence angle near the beginning of the vane, i.e., a very slightly convex wall, taken radially. Convex is, of course, to be preferred over a concave wall, in theory, but the degree of wall radial curvature is nearly academic anyway.

The latter portion of the passage:

Refer now to FIG. *1b*, its left hand portion repeating a good deal of FIG. *1a*, done for continuity, and FIG. *2b*. They show the remainder of the diffuser passages after source-vortex flow has been discontinued, for two purposes, namely, (A) to help visualize the diffuser as a whole, and also (B) to discuss a remaining very important requirement of design, not claimed as a part of this invention.

Repeating, the ultimate contribution from the invention is gradually to convert entering obliquie isobars, claimed herein asnow invented, to normal isobars bound to exist at or before the diffuser exit. Much of the advantage of this invention of now achieving oblique isobars at the "throat" can easily be lost by careless design thereafter, causing conversion to norml isobars to be too sudden rather than gradual, simply relocating the same heretofore "sin" of near-shock treatment of the gas at the entrance, now made avoidable by this invention, to near-shock treatment later on in the passage, thus continuing some of the current defeat, as to improving diffuser efficiency. This error can take place if the different method of passage area and vane contour required when the early isobars are highly oblique, be ignored in favor of the heretofore area evaluation by normal cross sections, correct when isobars have been always normal.

Referring again to the inventor's published workable method of arriving at vane-side contours assuming early isobars to be oblique, the effective cross section area along an oblique isobar is the product of that longer isobar length, times the sine of the angle $\gamma$ between isobar and mean flow direction, (a relatively small angle when the isobar is very oblique,) times the mean diffuser width along the isobar (constant width only if sidewalls are parallel); application by trial-and-error of this method of vane design results in quite different vane contours than those that result from use of normal cross section areas correctly used heretofore.

In FIG. *1b*, but with zero vane contour computation herein because pre-published, and thus not a part of this invention, are shown three options: "X" (solid lines), "Y" and "Z" (broken lines) of the vane contours after the eighth vane station where source-vortex flow has been discontinued.

Only to illustrate minimally here this suggested proper concept of true effective areas with oblique isobars at entrance and normal isobar at exit, the exit Mach number at the last normal isobar is easily computed herein, for option X only. This is based simply on application of the isentropic gas table for air, to effective inlet area and normal outlet area and at an assumed overall diffuser efficiency of 94%. The important point here to emphasize the principle of the method just referred to, is that here the inlet area at the tip circle is the product of that circle's arc length between two adjacent tips, times the sine of 22.5° $\alpha_1$ (vane tip and entering flow angle,) times the tip circle width. The unexciting (higher than desired) exit Mach number resulting is not revelant because as explained above, these later vane and wall contours were not computed herein beyond the 8th station point of discontinuing source-vortex flow, merely fudged in thereafter, from experience, not being a part of this disclosure.

C. Step by Step Mathematical Detail of Computing Successive Stations or a Vaneless Diffuser Source-Vortex Spiral Path This was used by this inventor to compute the non-deflecting vane-sides and side-walls for a vaned diffuser, i.e., source-vortex path vane-sides.

Reference and credit: E. S. Taylor, pages 570 to 572, of Volume 10, of a 12-volume series entitled, High Speed Aerodynamics and Jet Propulsion, Princeton University Press, 1964; (plus the straight-forward elementary calculus book integral equation for determining Central Polar Angles of spiral stations, here corresponding to the width ratios, M's, $\alpha$'s, and R's first determined by Taylor's method, for each station.)

NOMENCLATURE:

A. Incremental area normal to flow direction of a spiral gas path.

$m$ Mass flow per unit time.

M Mach No.

$\rho$ Density corresponding to Mach No.

$v$ Velocity corresponding to Mach No.

$h$ Width of vaneless diffuser between side-walls, (or width of a vane-side in this invention).

$\alpha$ Angle between station tangent to spiral flow path and tangent to great circle of radius R about the impeller-diffuser axis, through station.

R Radius of great circle through station, about the impeller-diffuser axis.

$\theta$ Central polar angle of a station on a spiral path from $\theta = 0$ at some point on the vaneless entering $R_1$ great circle about the impeller-diffuser axis (or at a vane tip on the tip circle $R_1$ in this invention).

$\Delta\ \theta$ Station-to-station incremental $\theta$.

Sub and superscripts:

o Value of any variable when M = 0.

1 Value of any variable when M = 1.0.

1 Value of any variable at the vaneless entering great circle $R_1$ and at the vanetip circle $R_1$ of my vanes.

PRE-ASSIGNED FIXED VALUES for one major diffuser design:

$M_1$, $\alpha_1$, $R_1$, and $h_1$

REQUIRED TO FIND:

Station M

Station $\alpha$

Station $R/R_1$ (spiral coordinate)

Station $\theta$ (spiral coordinate)

FINDING STATION $\alpha$ $$A = 2\pi\ R\ h \sin\alpha \quad (1).$$

The continuity of mass equation:

$$m = \rho v A = \rho_1 v_1 A_1, \text{ or } \rho\ v 2\pi\ Rh \sin\alpha = \rho_1 v_1 2\pi R_1 h_1 \sin\alpha_1 \quad (2).$$

The constant angular momentum equation:

$$R\ v \cos\alpha = R_1\ v_1 \cos\alpha_1 \quad (3).$$

Dividing equation (2) by (3), and by $2\pi$, we get:

$$\rho h \tan\alpha = \rho_1 h_1 \tan\alpha_1, \text{ or } \tan\alpha = \rho_1/\rho \times h_1/h \times \tan\alpha_1 \quad 4).\ 4.$$

PROCEDURE

Assume for a station, an M, and a vaneless diffuser width $h$ between walls, (or a vane-side width $h$ for this invention).

find $h_1/h$ find tan $\alpha_1$ find, determined by M's (isentropic gas tables), $\rho_1/\rho_o$ and $\rho/\rho_o$ find $\rho_1/\rho$, $= \rho_1/\rho_o$ divided by $\rho/\rho_o$ find, determined by M/s (gas tables) $v_1/v^*$ and $v/v^*$ (for use later on)

find $v_1/v$, $= v_1/v^*$ divided by $v/v^*$ (for use later on)

The first 4 steps establish all the right-hand values of equation (4), from which Find Tan $\alpha$ at the station Find $\alpha$ sought for the station.

FINDING STATION COORDINATE $R/R_1$

The required incremental flow area normal to flow direction varies inversely as the decrease in velocity from that at the tip station.

The required radius to that area varies directly with the ratio of $\sin\alpha_1/\sin\alpha$ and varies directly as diffuser (or vane-side) width ratio $h_1/h$ Therefore the $R/R_1$ sought is (after 3 more steps: find $\sin\alpha_1$, $\sin\alpha$, and $\sin\alpha_1/\sin\alpha$)

$$R/R_1 = v_1/v \times \sin\alpha_1/\sin\alpha \quad (5).$$

FINDING STATION COORDINATE $\theta$

For any spiral per elementary calculus books, the central polar angle is:

$$\theta - \underset{(=0)}{\theta_1} = \int_{R_1}^{R} \frac{\cot\alpha}{R} \times dR, \text{ or in this application:}$$

$$\theta = \int_{\frac{R_1}{R_1}}^{\frac{R}{R_1}} \frac{\cot\alpha}{\frac{R}{R_1}} \times d\frac{R}{R_1}) \quad (6)$$

$$= 1.0$$

PROCEDURE

The curve of $\cot\alpha R/R_1$ vs $R/R_1$ is represented by a complex equation difficult to integrate formally. With sufficiently close stations, i.e., sufficiently small $\Delta\ R/R_1$'s, it may be integrated graphically, in principle, but actually without the graph. One needs to plot only once, for any fixed major design choice of $M_1$, $\alpha_1$, $R_1$ and approximate $h/_{h1}$, width ratio schedule, a curve of $\cot\alpha/R/R_1$ as ordinate, vs. $R/R_1$ as abcissa, incremental areas under the curve of course being $\Delta\ \theta$'s, station-to-staion, in radians.

This starting plot is simply to make sure that the curvature of the above curve is sufficiently gentle for incremental station-to-station areas under the curve, bounded by 2 ordinates from adjacent-station $R/R_1$'s on the abscissa, (.i.e. $\Delta\ R/R_1$'s,) is accurately represented by taking the mean of those 2 adjacent station ordinates to be very closely the height of the incremental area under the curve. If the accuracy seems impaired by this taking of a mean height of the 2 sides of the $\Delta\ R/R_1$ abscissa incremental area, then the initial station-by-station M's assumed long ago must be assumed in smaller steps, for stations to be found which are closer together. (This has not been the case during this project). If the accuracy seems valid, then henceforth the curve is ignored, and finite step-by-step $\Delta\ \theta$ integration for successive $\theta$'s is done by numerical computation only, but as though done graphically, as follows:

Step NO.

1. Find $\cot\alpha$
2. Find $\cot\alpha/R/R_1$ (station ordinate to curve at $R/R_1$ abscissa
3. Take $\cot\alpha/R/R_1$ ordinate of previous station.
4. Find mean of these 2 ordinate heights to the curve of $\cot\alpha/R/R_1$ vs $R/R_1$ on the abscissa. (Actual curve not used after 1st inspection for gentle enough curvature and accuracy of a mean $\Delta R/R_1$ ordinate height taken.)

5. Take $R/R_1$ just found for this station sought.
6. Take $R/R_1$ of previous station
7. Find difference between these steps 5 and 6, for $\Delta R/R_1$ on abscissa.
8. Multiply step 4 by step 7. This is the station-to-station $\Delta \theta$, or incremental area under the curve, in radians.
9. Multiply step 8 by 57.296° per radiam, for $\Delta \theta$ in degrees.
10. Add the $\theta$ found for the previous station; this is the $\theta$ of the station sought, for the M and h assumed for the station, 22 steps ago.

For a parallel wall vaneless diffuser path, provided the stations sought are not too far apart for accuracy of finite station-to-station integration steps determining finite station-to-station incremental central polar angles (increments $\Delta \theta$), a single straightforward station-to-station computation by this process is valid, i.e., the spiral station locations found are correct for use.

But when the walls diverge according to a preassigned schedule, i.e., the vaneless or vane-side widths are widened increasingly with increase in $\theta$ along the spiral according to a preassigned $h/h_1$ vs $\theta$ width-ratio schedule, this 22-step computation must be repeated many times for each station to converge by trial and error on the $\theta$ for the station at which the width ratio $h_1/h$ used in the computation has been preassigned to exist. Otherwise, a path will at first have been determined which through true, its preselected side-wall divergence schedule has not been met; instead, wavy and thus impractical side-walls will have to accompany that first-calculated spiral.

Therefore repeat the 22-step process from the beginning assuming successive new assumptions of M, until the Station $\theta$ resulting is the same as the station $\theta$ preassigned to the width ratio $h/h_1$ used.

An iteration-programmed computer will make short work of this, but not found to be so, when using a human computer, as in this project.

I claim:

1. A vaned diffuser for centrifugal compressors, wherein, as applied to the radially inner portion of the whole diffuser, there are defined a plurality of passages each extending from an initial vane tip to a throat, said passages being bounded on their radially inner side by a vaneless open region each pair of adjacent passages being separated by a vane, the side-walls of each individual passage diverging radially outwardly from each other as sectioned on a plane parallel with and intersecting the impeller-diffuser axis, the relative dimensions of the cross sections of at least one pair of adjacent passages being such that the vane width between side-walls, of the separating vane which bounds the radially inner side of the outer of said 2 adjacent passages, is less than the width between side-walls of the other side of the same vane, which side bounds the radially outer side of the inner adjacent passage.

2. A vaned diffuser for centrifugal compressors, wherein, for at least a portion of a vane beginning at its tip, and proceeding in the downstream direction, the suction side width of said vane grows wider from side-wall to side-wall, than does the pressure side width of the same vane, between its side-walls.

3. A vaned diffuser for centrifugal compressors, wherein, for the radially inner portion of the whole diffuser, there are defined a plurality of passages each extending from an initial vane tip to a throat, said passages being bounded on their radially innermost side by a vaneless open region the passages being configured such that when two or more adjacent passages separated by vanes are sectioned together on a radial plane parallel with and intersecting the impeller-diffuser axis, diverging passage side-wall inner surfaces of at least two adjacent passages when viewed together in said section appear sawtoothed, the sawteeth being located at said separating-vane locations.

4. A vaned diffuser for centrifugal compressors, wherein, at some station of gas travel distance along a vane from its tip, till which said station the suction side of said vane has been growing wider and is there wider than its pressure side, the two respective width-growth schedules are reversed, the pressure side at further distances of gas travel along the vane growing wider at a higher rate than the width-growth rate of the suction side, until both sides of the same vane are again more nearly of the same width, or exactly of the same width.

5. A vaned diffuser for centrifugal compressors, wherein, starting at a throat, cross sections of a passage taken at successive stations along said passage in the direction of gas flow and lying on radial planes parallel with and intersecting the impeller-diffuser axis, successively change in shape from initially having opposite side-wall inner surfaces continuously and distinctly diverging radially outwardly from each other and resulting in a substantially trapezoidal passage cross section shape, to later having at the outermost extremity of the passage side-walls' radial height, parallel or more nearly parallel opposite passage side-walls over only a small percentage of said side-wall radial height, the remainder of the side-walls' radial height being relatively little changed as to their distinct degree of wall-divergence, there being at successive stations increasingly larger percentages of the radially outer side-walls' height that are more nearly parallel or parallel and lesser percentage that are relatively diverging, until at some later station the passage side-walls are more nearly parallel or exactly parallel over the entire individual passage side-wall radial height, thus, causing the passage cross section shape to become more nearly rectangular or exactly rectangular, in contrast to the initially described substantially trapezoidal passage cross section which applies for some distance of gas travel after the throat and prior to the change in cross section shape.

6. A vaned diffuser for centrifugal compressors, wherein, there is a sawtoothed configuration to the inner surfaces of the side-walls on a radial section taken over two or more adjacent passages of the radially inner portion of the diffuser, said section being taken on a plane parallel with and intersecting the impeller-diffuser axis, the saw teeth reaching a maximum tooth depth at some station of gas travel between a vane tip and a throat, and thereafter said tooth-depth diminishing with gas travel along the vane until it is more nearly zero, or alternatively, the saw teeth disappearing altogether and resulting, at larger diffuser diameters in radially smooth continuous diffuser inner side-wall surfaces except where interrupted by vanes.

* * * * *

UNITED STATES PATENT OFFICE

CERTIFICATE OF CORRECTION

Patent No. 4,099,891 Dated July 11, 1978

Inventor(s) Kenneth Campbell

It is certified that error appears in the above-identified patent and that said Letters Patent are hereby corrected as shown below:

Column 13, line 12 "22.5 inches" should read --22.5 degrees--.

Column 16, lines 6 thru 15 should read
--The law of constant angular momentum is that at any radius R, the product of R times the tangential component of velocity v is a constant. Therefore:

$$\frac{R}{R_1} = \frac{v_1}{v} \times \frac{\cos \alpha_1}{\cos \alpha} \qquad (5)$$ --.

Signed and Sealed this

Nineteenth Day of December 1978

[SEAL]

Attest:

RUTH C. MASON
Attesting Officer

DONALD W. BANNER
Commissioner of Patents and Trademarks